United States Patent [19]

Dixon et al.

[11] 4,105,275

[45] Aug. 8, 1978

[54] HEADER WITH INTEGRAL LATCH MEMBERS

[75] Inventors: Daniel Allen Dixon, West Chester, Pa.; George Thomas Eigenbrode, Wilmington, Del.

[73] Assignee: E. I. Du Pont de Nemours and Company, Wilmington, Del.

[21] Appl. No.: 825,646

[22] Filed: Aug. 18, 1977

[51] Int. Cl.[2] ..... H01R 13/54; H05R 1/10

[52] U.S. Cl. ..... 339/91 R; 339/17 F; 339/176 MF; 361/413

[58] Field of Search ..... 339/17 L, 17 F, 75 MP, 339/91 R, 176 MF, 176 MP; 361/399, 413, 415

[56] References Cited

U.S. PATENT DOCUMENTS

| | | | |
|---|---|---|---|
| 3,567,998 | 3/1971 | Ammerman | 339/17 L X |
| 3,829,741 | 8/1974 | Athey | 361/415 X |
| 3,932,016 | 1/1976 | Ammenheuser | 339/75 MP X |
| 3,993,390 | 11/1976 | Eigenbrode | 339/17 L X |
| 4,017,138 | 4/1977 | Evans | 339/75 MP |

*Primary Examiner*—Roy Lake
*Assistant Examiner*—E. F. Desmond

[57] ABSTRACT

A vertical header with an integral housing surrounding a block through which straight pins extend. The pins project beyond one face of the housing that is adapted for mounting against a circuit board. Above the block, the housing and pins receive an electrical connector. At each end of the housing block, there is a latch member that extends upwardly from the block for engagement with a connector fitted into the housing.

4 Claims, 4 Drawing Figures

HEADER WITH INTEGRAL LATCH MEMBERS

BACKGROUND OF THE INVENTION

This invention relates generally to electrical connectors and, more particularly, to headers for mounting on circuit boards and releasably receiving a connector having a plurality of electrical terminals which mate with pins mounted in the header.

Electrical connectors suitable for use with the header of the present invention are described in U.S. Pat. No. 3,781,760 to Mancini et al. and U.S. Pat. No. 3,820,058, to Friend. Vertical headers are known in the art but none has integral latches that are in part contained within the header and protected against inadvertent release. A right angle header with insertable latch members is described in U.S. Pat. No. 3,993,390 to Eigenbrode.

SUMMARY OF THE INVENTION

According to the present invention, a vertical header is provided for mounting on a circuit board and includes both a block having a plurality of circuit board pins mounted therein and a generally rectangular integral housing surrounding the block. The housing includes a bottom face for mounting on a surface of the circuit board and has a cavity at each end. An integral latch member extends upwardly in each cavity. Each latch member includes spaced arms joined to the block and a latch joining the arms at their outer ends. A latch release element extends beyond the top of the housing.

DETAILED DESCRIPTION OF A PREFERRED EMBODIMENT

A preferred embodiment of the header and latch member of the present invention is described below with reference to the attached drawing wherein the same numerals are used throughout the various views to identify the same elements.

Figure 1:
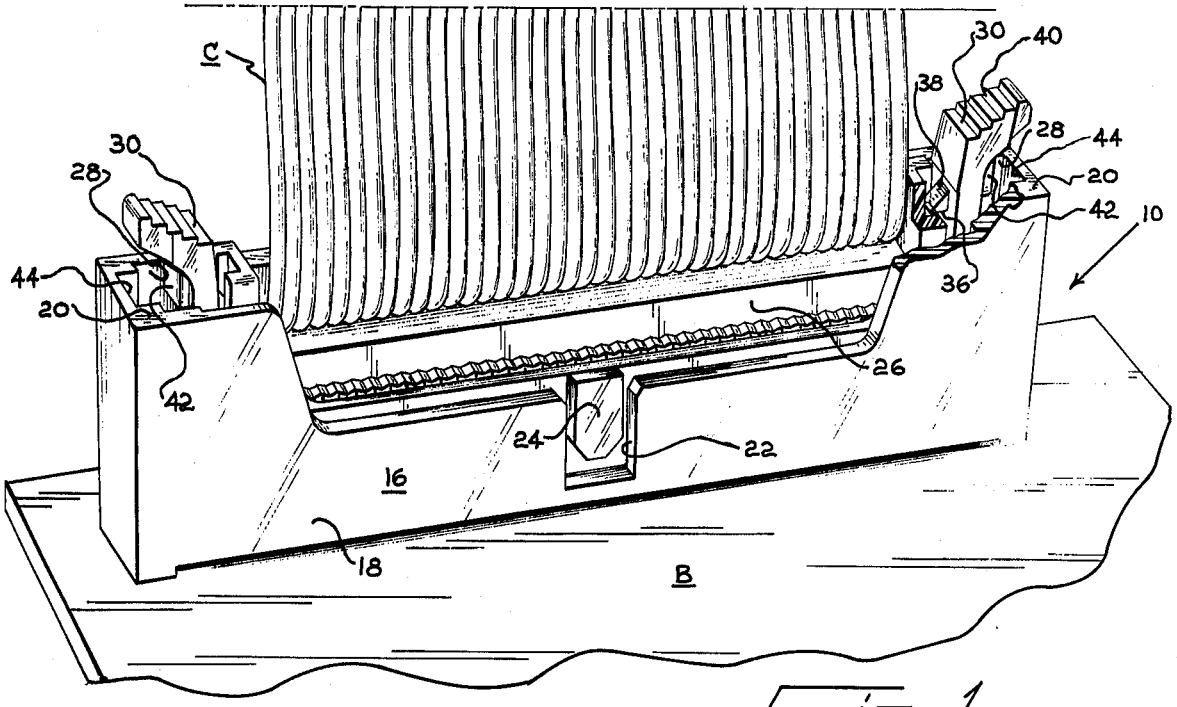
FIG. 1 is a perspective view of an embodiment of a connector in a header mounted on the surface of a circuit board.
Figure 2:
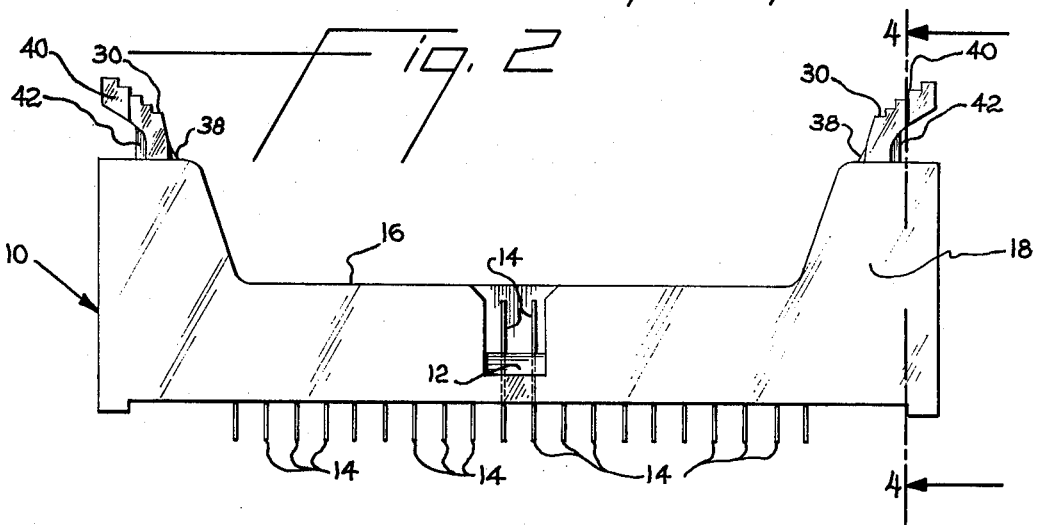
FIG. 2 is a side view of the header shown in FIG. 1.
Figure 4:
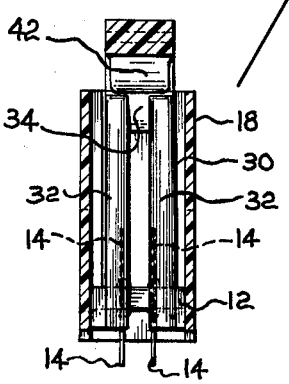
FIG. 4 is a sectional view taken along line 4—4 of FIG. 2.
Figure 3:
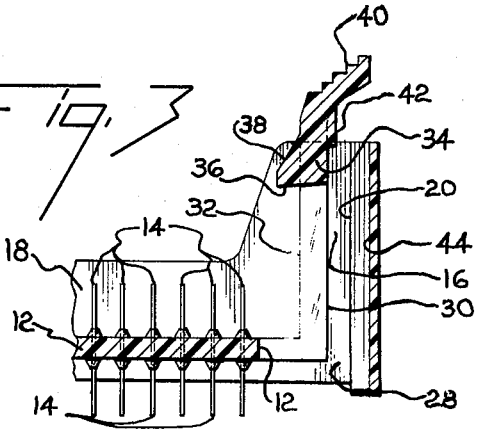
FIG. 3 is a fragmentary sectional view of the header of FIG. 2.

As illustrated, a header 10 includes a block 12 having a plurality of pins 14 molded therein and a housing 16. Header 10 has a lower surface mounted on a circuit board B (FIG. 1). The housing 16 has side walls 18, end walls 20 and a recess 22 in one of the side walls for receipt of a polarizing key 24 on a connector 26. Connector 26 fits within housing 16 between side walls 18 and contains terminals of the type disclosed by Friend. Such terminals have contacts at one end that mate with the upper ends of pins 14 and insulation-displacing contacts at their other ends that engage the conductors in a tape cable C.

Between the ends of block 12 and end walls 20, there are cavities 28 extending through the height of housing 16. An integral latch member 30 projects upwardly in each cavity 28. Each latch member 30 has a spaced pair of upright arms 32 joined to block 12. At their outer ends, arms 32 are joined by an integral latch 34 that has a slightly sloped latch surface 36, a cam surface 38 and an obliquely disposed release element 40. Opposite latch surface 36, there is a boss 42 that keys in a channel 44 in end wall 20 when a connector 26 engages cam surfaces 38 and bends arms 32. After insertion of connector 26, latch surfaces 36 engage and retain it in housing 16.

Bosses 42 are normally spaced from end walls 20. Thus, slight twisting movement of the arms 32 is permitted as a connector 26 engages cam surfaces 38. Excessive twisting is avoided as boss 42 is guided into channel 44. With boss 42 in channel 44, sloped latch surface 36 is in a position to receive connector 26 and is flush with the top of the connector when the arms snap back toward their normal positions. Side walls 18 serve as guides for connector 26 as it is inserted. The side walls also isolate the upper ends of pins 14 before insertion of a connector and isolate the latches after insertion.

The header and integral latches shown herein were molded from a 15% glass filled polyester. Other polymers such as polyamides may also be used, with or without reinforcement.

What is claimed is:

1. A vertical header adapted to receive a connector having a plurality of electrical terminals mounted therein, said header comprising: an elongated block having a plurality of straight pins mounted therein and a generally rectangular, unitary housing surrounding said block, said header having a lower face for mounting against a surface of a circuit board, said housing having a cavity at each end of said block extending from said lower face to the top of the housing; and a latch member extending from each end of the block integrally molded with the block, each latch member including a pair of elongated arms extending from said block and a latch joining the arms at their outer ends, said latch having a latch surface extending from a side thereof toward the other latch.

2. The header of claim 1, each latch member additionally comprising a latch release element extending at an oblique angle from the latch.

3. The header of claim 1, each latch having a cam surface above its latch surface, said cam surfaces being adapted for engagement by a connector.

4. The header of claim 3, each latch having a boss opposed to its latch surface, said housing having end walls with recesses adapted to receive the bosses as the latch members are cammed by the insertion of a connector.

* * * * *